US005598147A

United States Patent [19]

Mochizuki et al.

[11] Patent Number: 5,598,147

[45] Date of Patent: Jan. 28, 1997

[54] SMOKE DETECTING APPARATUS FOR FIRE ALARM

[75] Inventors: Mikio Mochizuki; Hideo Ito; Ryousaku Kobayashi, all of Tokyo, Japan

[73] Assignee: Nohmi Bosai Ltd., Tokyo, Japan

[21] Appl. No.: 552,175

[22] Filed: Nov. 2, 1995

Related U.S. Application Data

[63] Continuation of Ser. No. 144,421, Nov. 2, 1993, abandoned.

[30] Foreign Application Priority Data

Nov. 4, 1992 [JP] Japan ..... 4-319351
Nov. 5, 1992 [JP] Japan ..... 4-321277

[51] Int. Cl.[6] ..... G08B 17/10

[52] U.S. Cl. ..... 340/630; 340/628; 250/573; 250/574

[58] Field of Search ..... 340/628, 629, 340/630; 250/573, 574, 575, 576; 356/437, 438, 439

[56] References Cited

U.S. PATENT DOCUMENTS

| | | | |
|---|---|---|---|
| 3,866,195 | 2/1975 | Ried, Jr. | 340/237 |
| 4,097,850 | 6/1978 | Conforti | 340/214 |
| 4,193,069 | 3/1980 | Cooper et al. | 340/630 |
| 4,524,351 | 6/1985 | Kimura et al. | 340/629 |
| 4,675,661 | 6/1987 | Ishii | 340/630 |
| 4,695,734 | 9/1987 | Honma et al. | 250/573 |
| 4,825,196 | 4/1989 | Morita | 340/531 |
| 4,977,527 | 12/1990 | Shaw et al. | 364/571.03 |
| 5,302,837 | 4/1994 | Sawa et al. | 250/574 |

*Primary Examiner*—Jeffery Hofsass
*Assistant Examiner*—Ashok Mannava
*Attorney, Agent, or Firm*—Wenderoth, Lind & Ponack

[57] ABSTRACT

A smoke detecting apparatus for a fire alarm has a smoke chamber into which smoke to be detected is introduced, a light emitting lamp disposed in the smoke chamber, a light receiving element disposed in the smoke chamber so as to receive the light emitted from the light emitting lamp, an amplification device for amplifying an output signal from the light receiving element, a detection device for detecting the density of the smoke on the basis of an output signal from the amplification device, a comparison device for comparing the value of the output signal from the amplification device with a fixed value, an abnormality output device for outputting an abnormality indication when the value of the output signal from the amplification device is judged to be smaller than the fixed value by the comparison device, an augmentation command switch for commanding augmentation of the value of the output signal from the amplification device, and an augmentation device for augmenting, in accordance with a command from the augmentation command switch, the value of the output signal of the amplification device which is input to the comparison device.

17 Claims, 15 Drawing Sheets

FIG. 6

DATA STORED IN EEPROM 63

| MONTH AFTER INSTALLATION | NUMBER OF LIGHT EMISSION FAILURES |
|---|---|
| FIRST MONTH | 0 |
| SECOND MONTH | 0 |
| THIRD MONTH | 0 |
| FOURTH MONTH | 0 |
| FIFTH MONTH | 0 |
| SIXTH MONTH | 0 |
| SEVENTH MONTH | 1 |
| EIGHTH MONTH | 1 |
| NINTH MONTH | 3 |
| TENTH MONTH | 2 |
| ELEVENTH MONTH | 3 |
| TWELFTH MONTH | 5 |
| THIRTEENTH MONTH | 10 |

TRANSITION OF NUMBER OF LIGHT EMISSION FAILURES AND ALARM LEVEL (Amax)

SMOKE DETECTING APPARATUS FOR FIRE ALARM

This application is a continuation of now abandoned application, Ser. No. 08/144,421, filed Nov. 2, 1993.

BACKGROUND OF THE INVENTION

1. Field of the Invention

This invention relates to a smoke detecting apparatus for a fire alarm having a smoke chamber in which a light emitting lamp like a xenon lamp and a light receiving element are provided. Light from the light emitting lamp is received by the light receiving element, and the density of smoke caused by a fire is detected in accordance with an output signal emitted from the light receiving element.

2. Description of the Related Art

In a conventional smoke detecting apparatus in which the density of smoke introduced into a smoke chamber is detected in accordance with an output signal of a light receiving element which receives light emitted from a xenon lamp, the level of the output signal of the light receiving element is gradually lowered as the light emission efficiency of the xenon lamp and the light reception efficiency of the light receiving element are deteriorated, or as the xenon lamp and the light receiving element are contaminated, as a result of a change which takes place over a period of time.

This lowering of the output signal level of the light receiving element results in the smoke detecting apparatus becoming incapable of operating normally. In such a case, a warning, e.g., an alarm, is given to indicate the abnormal condition of the xenon lamp or the light receiving element. After a person has noticed this warning and maintenance work such as replacement and cleaning of the xenon lamp, the light receiving element, etc., has been performed, the smoke detecting apparatus is capable of operating normally again.

In the above-described conventional technique, the maintenance work such as the replacement and cleaning of the xenon lamp, the light receiving element, etc., must be executed in order that the smoke detecting apparatus may operate normally again. However, this maintenance work such as the replacement and cleaning of the xenon lamp, the light receiving element, etc., is not the kind of work that any person can perform. In particular, a high-sensitivity smoke detector is usually sent to a service plant for maintenance.

Further, in the case of such a high-sensitivity smoke detector, periodical maintenance is executed thereon, for example, every two years, at which time the xenon lamp is replaced with a new one. In this case, the smoke detecting apparatus needing maintenance is detached from its location, and an alternate normal smoke detecting apparatus is installed in its place. After the former detecting apparatus has finished undergoing the requisite maintenance at the service plant, it is installed at its location again, the alternate one being taken away. In this way, the continuity of the smoke detecting operation is maintained.

The above-described conventional smoke detecting apparatus, however, has a problem in that if there is no alternate smoke detecting apparatus at hand at the time that the level of the output signal of the light receiving element is lowered, the continuity of the smoke detecting operation has to be interrupted. Furthermore, the normal smoke detecting operation cannot be started again until an alternate smoke detecting apparatus has been installed. This problem is also experienced when a light emitting lamp other than a xenon lamp is used.

SUMMARY OF THE INVENTION

It is an object of the present invention to provide a smoke detecting apparatus for a fire alarm which allows continuation of the normal smoke detecting operation even if there is no alternate smoke detecting apparatus at hand at the time that the level of the output signal of the light receiving element is lowered.

In accordance with the present invention, there is provided a smoke detecting apparatus for a fire alarm comprising: a smoke chamber into which smoke to be detected is introduced; a light emitting lamp disposed in the smoke chamber; a light receiving element disposed in the smoke chamber so as to receive the light emitted from the light emitting lamp; amplification means for amplifying an output signal from the light receiving element; detection means for detecting the density of the smoke on the basis of an output signal from the amplification means; comparison means for comparing the value of the output signal from the amplification means with a fixed value; an abnormality output means for outputting an abnormality indication when the value of the output signal from the amplification means is judged to be smaller than the fixed value by the comparison means; augmentation command switch means for commanding augmentation of the value of the output signal from the amplification means; and augmentation means for augmenting, in accordance with a command from the augmentation command switch means, the value of the output signal of the amplification means which is input to the comparison means.

BRIEF DESCRIPTION OF THE DRAWINGS

FIG. 6 shows an example of data of the numbers of light emission failures stored in an EEPROM 63 in the embodiment;

DESCRIPTION OF THE PREFERRED EMBODIMENTS

Figure 1:
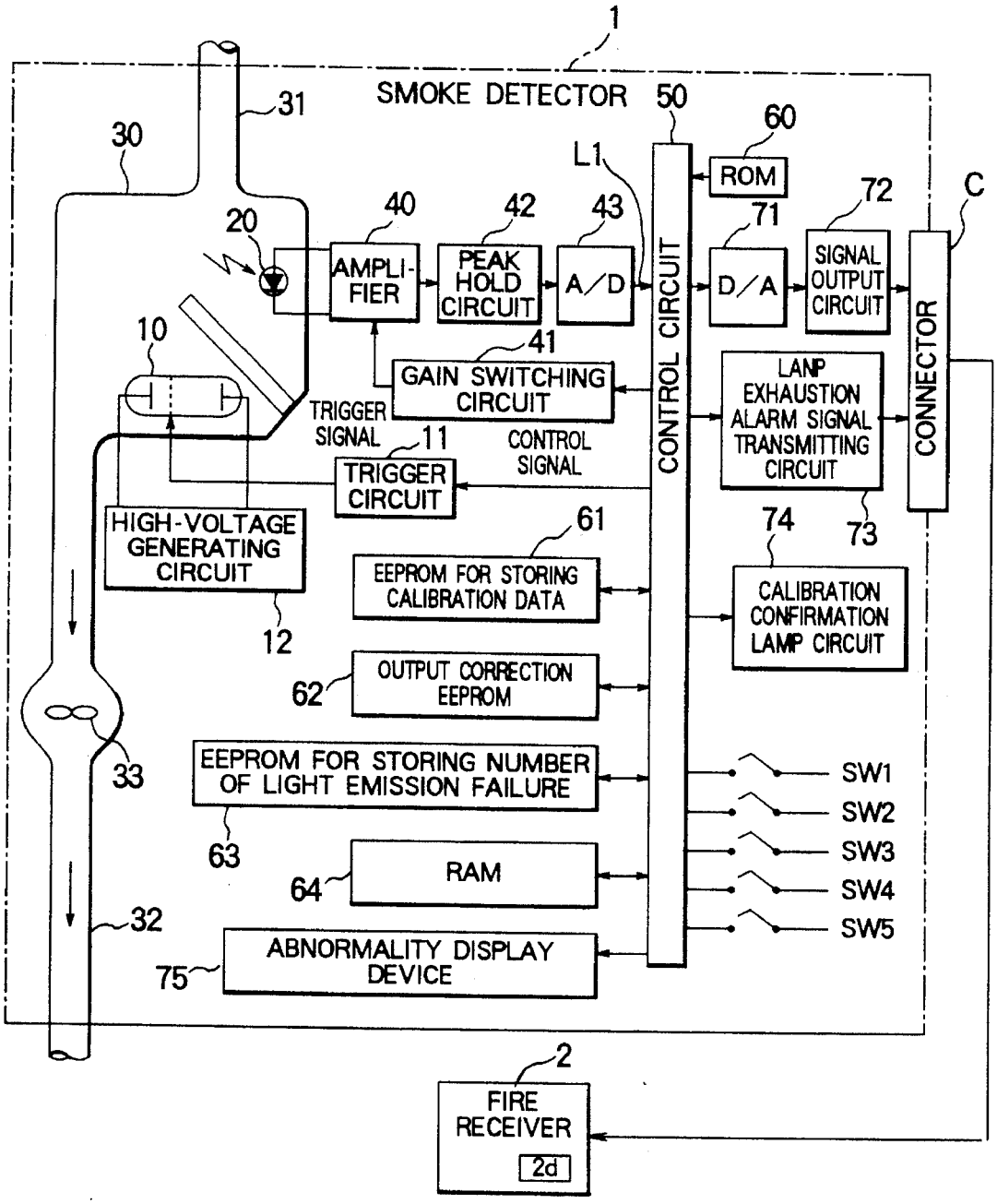
FIG. 1 is a block diagram showing a smoke detecting apparatus according to an embodiment of the present invention.

FIG. 1 is a block diagram showing a smoke detecting apparatus according to an embodiment of the present invention.

In a smoke detector 1 of this embodiment, a xenon lamp 10 and a light receiving element 20 are provided in a smoke chamber 30 in the state where the xenon lamp 10 and the light receiving element 20 are separated by a light shielding plate 34. The light emitted from the xenon lamp 10 is scattered by smoke in the smoke chamber 30 and then reaches the light receiving element 20.

A high voltage required for emission is supplied to the xenon lamp 10 from a high-voltage generating circuit 12, and the emission timing thereof is controlled by the trigger signal supplied from a trigger circuit 11. The trigger circuit 11 generates the trigger signal on the basis of the control signal supplied from a control circuit 50.

The smoke chamber 30 is connected to a sampling pipe 31 for introducing into the smoke chamber 30 an atmosphere where the smoke detector 1 is installed, and a pipe 32 for discharging the air in the smoke chamber 30 to the outside of the smoke detector 1. An aspiration fan 33 is provided in the pipe 32.

An amplifier 40 amplifies the output signal from the light receiving element 20, the gain of the amplifier 40 being controlled by a gain switching circuit 41. A peak holding circuit 42 holds the peak of the output signal from the amplifier 40, and an A/D converting circuit 43 converts the analog signal output from the peak holding circuit 42 into a digital signal.

The control circuit 50 comprises a microcomputer or the like for controlling the overall operation of the smoke detector 1 and determining the current smoke density in the smoke chamber 30 on the basis of the digital signal from the A/D converting circuit 43.

Figure 2:
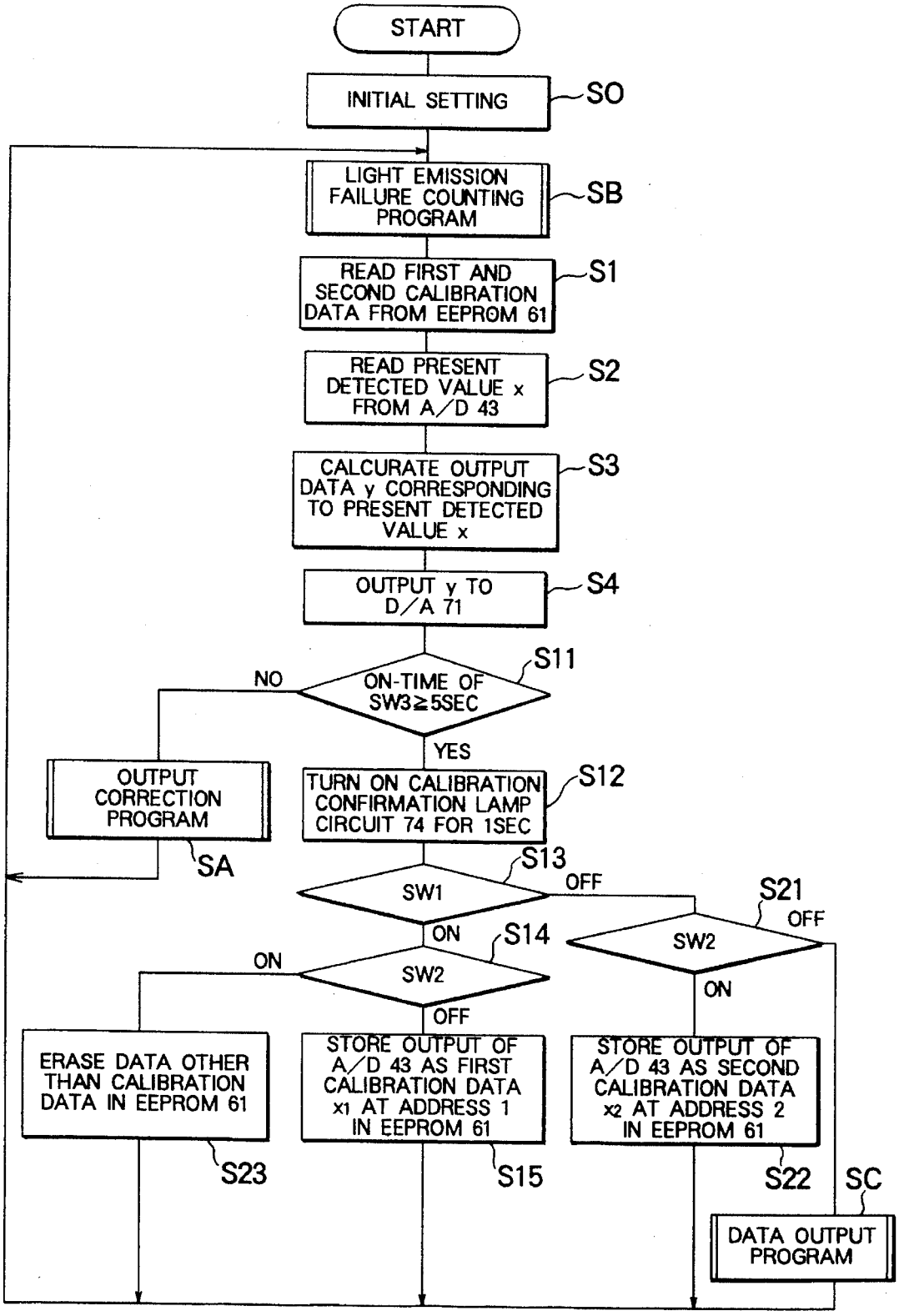
FIG. 2 is a flowchart showing the operation of the embodiment.

A ROM (read only memory) 60 stores the program shown in the flow chart of FIG. 2. An EEPROM (electrically erasable and programmable ROM) 61 stores as first calibration data the output data from the A/D converting circuit 43 when pure oxygen gas (first reference gas) is sucked into the smoke chamber 30, for example, at 1 atm and room temperature, and stores as second calibration data the output data from the A/D converting circuit 43 when pure fleon 12 gas (second reference gas) is sucked into the smoke chamber 30.

An output correction EEPROM 62 is a ROM for storing a value K which indicates the number of times that the gain of the amplifier 40 has been corrected. The correction is made in several steps when the output level of the amplifier 41 has become lower than a predetermined value.

An EEPROM 63 is a ROM for storing the number of incidences where the xenon lamp 10 fails to emit light when it is supposed to do so (the number of light emission failures) in each month. A RAM (random access memory) 64 is a memory for working. The EEPROMs 61, 62 and 63 are examples of nonvolatile memories which can be electrically rewritten.

Figure 4A:
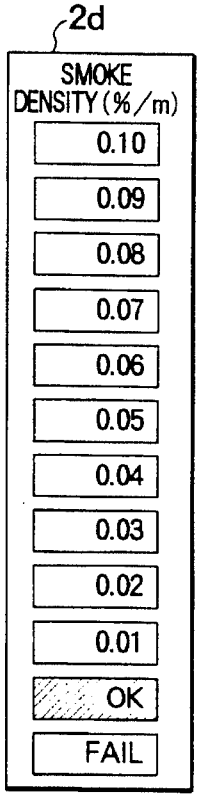
FIGS. 4A to 4C are drawings each showing a smoke density display device 2*d* provided on a receiver.
Figure 4B:
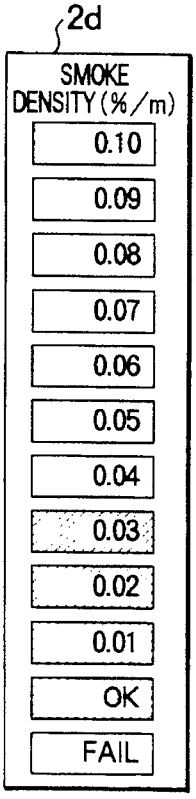
Figure 4C:
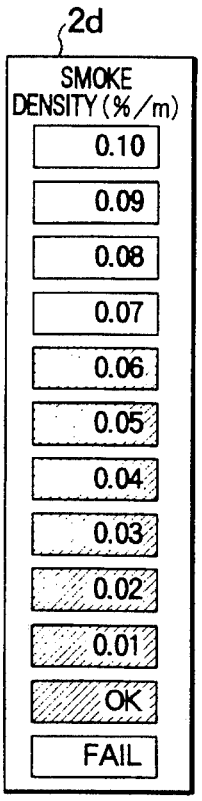

A D/A converting circuit 71 converts the digital signal output from the control circuit 50 into an analog signal for transmitting the signal to a fire receiver 2 through a signal output circuit 72 and a connector C. The receiver 2 is provided with a smoke density display device 2*d* for displaying a smoke density, as shown in FIGS. 4A to 4C.

A signal output circuit 72 is a circuit for outputting a signal corresponding to the density of smoke detected. Further, it transmits the first and second calibration data stored in the ROM 61, transmits data stored in the ROM 62 indicating the number of times that a gain augmentation command switch has been operated, and transmits data stored in the ROM 63 indicating the number of light emission failures.

A lamp exhaustion alarm signal transmission circuit 73 is a circuit for transmitting a signal warning that the service life of the xenon lamp 10 is about to expire.

A calibration confirmation lamp circuit 74 indicates that the sensitivity of the smoke detector 1 is being adjusted.

Switches SW1 and SW2 are lock-type switches which are operated according to the types of the gases used for calibrating the sensitivity of the smoke detector 1, and a switch SW3 is a nonlock-type switch which is turned on for 5 seconds or more when the sensitivity of the smoke detector 1 is calibrated.

The operation of the above embodiment is described below. FIG. 2 is a flowchart showing the operation of the above-described embodiment. Referring to this flowchart, in Step S0, initial setting is first performed to set the number of correction commands K and the function An to "0" and the function n to "1". Then, in Step SB, a light emission failure counting program for counting the number of times that the xenon lamp 10 has failed to emit light is executed. Smoke detecting operations are executed in Steps S1 through S4. Then, a judgment is made as to whether the switch SW3 has been turned on or not. If it has, a judgment is made as to how long the switch SW3 has been on. When the switch SW3 has been on for less than five seconds, the fact that the switch has been turned on is stored in the RAM 64 in Step S11, and when the output level of the A/D conversion circuit 43 has been lowered due to a reduction in the light emission efficiency of the xenon lamp 10 etc., an output correction program is executed in Step SA to augment the value of a digital signal supplied to the D/A conversion circuit 71. In the case where it is judged in Steps S11 that the switch SW3 has been on for five seconds or more, preparatory operations for adjusting the sensitivity of the smoke detector 1 are executed in Step S11 through S23. In the course of execution of these operations, a data output program for outputting various items of data stored in the EEPROM 61, 62 and 63 is executed in Step SC.

The preparatory operations for adjusting the sensitivity are described below.

Before the sensitivity of the smoke detector 1 is adjusted, the switch SW1 is turned on, and the switch SW2 is turned off, while the smoke chamber 30 is filled with pure oxygen through the sample pipe 31 at 1 atm and room temperature. In this state, the sensitivity adjustment command switch SW3 is turned on for 5 seconds or more. When it is decided in Step S11 that the sensitivity adjustment command switch SW3 is turned on for 5 seconds or more, the confirmation lamp of the calibration confirmation lamp circuit 74 is turned on, in Step S12, for 1 second for indicating that the operation of adjusting the sensitivity is started. At this time, since the switch SW1 is turned on and the switch SW2 is turned off, the flow moves to Step S15 through Steps S13 and S14. In Step S15, in the state where the smoke chamber 30 is filled with pure oxygen, the output signal from the light receiving element 20 is amplified, and the peak value of the amplified signal is held by the peak holding circuit 42, and is converted into digital data by the A/D converting circuit 43. The converted output data is stored as first calibration data $x_1$ in the EEPROM 61. The smoke detecting operation (Steps S1 to S4) is then executed.

The pure oxygen gas is then discharged from the pipe 32 by the aspiration fan 33, and the smoke chamber 30 is filled with pure fleon 12 through the sampling pipe 31 at 1 atm and room temperature. The switch SW1 is turned off, the switch SW2 is turned on, and the sensitivity adjustment command switch SW3 is turned on for 5 seconds or more. When it is decided in Step S11 that the sensitivity adjustment command switch SW3 is turned on for 5 seconds or more, the confirmation lamp of the calibration confirmation lamp circuit 74 is turned on, in Step S12, for 1 second for indicating that the sensitivity adjusting operation is started. Since the switch SW1 is turned off and the switch SW2 is turned on, the flow moves to Step S22 through Steps S13 and S21. In Step S22, in the state where the smoke chamber 30 is filled with the pure fleon 12, the output signal from the light receiving element 20 is amplified by the amplifier circuit 40, and the peak value of the amplified signal is held by the peak holding circuit 42, and is converted into digital data by the A/D converting circuit 43. The converted output data is stored as the second calibration data $x_2$ in the EEPROM 61. The smoke detecting operation below (Steps S1 to S4) is then executed. If both switches SW1 and SW2 are turned on, the flow moves to Step S23 through Steps S13 and S14, and data other than the calibration data stored in the EEPROM 61 is erased in Step S23. If both switches SW1 and SW2 are turned off, the flow moves to Step SC and the data output program is then executed.

The smoke density detecting operation including the sensitivity adjustment, i.e., the smoke detecting operation, is described below.

After the preparatory operation for sensitivity adjustment is completed, the first and second calibration data $x_1$, and $x_2$ are read from the EEPROM 61 in Step S1, and the present detected data (present output data from the A/D converting circuit 43) x is read in Step S2. In Step S3, data y to be output to the D/A converting circuit 71 and required for displaying, on the smoke density display device **2*d*, a proper smoke density corresponding to the present output data x is calculated by the control device 50 using the ROM 60** on the basis of the first and second calibration data $x_1$, and $x_2$, the present detected data x, the output data $y_1$, corresponding to the data $x_1$ and the output data $y_2$ corresponding to the data $x_2$. Namely, the sensitivity is adjusted.

The output data $y_1$ is the data to be output to the D/A converting circuit 71 and required for displaying, on the smoke density display device **2*d* of the fire receiver 2, the smoke density (about 0.005%/m) corresponding to oxygen gas used as the first reference gas. The output data $y_2$ is the data to be output to the D/A converting circuit 71 and required for displaying, on the smoke density display device 2*d* of the fire receiver 2, the smoke density (about 0.035 %/m) corresponding to fleon 12 gas used as the second reference gas. Both output data $y_1$ and $y_2$ are previously calculated and stored in the ROM 60. Namely, since the density of the oxygen gas corresponds to a smoke density of about 0.005%/m, only a "OK" portion of the smoke density display device 2*d* is lighted when oxygen gas is introduced into the smoke chamber 30, as shown in FIG. 4A. Since the density of the fleon 12 gas corresponds to a smoke density of about 0.035%/m, portions of "OK", "0.01", "0.02" and "0.03" in the smoke density display device 2*d* are lighted when the fleon 12 gas is introduced into the smoke chamber 30, as shown in FIG. 4**B.

Figure 3:
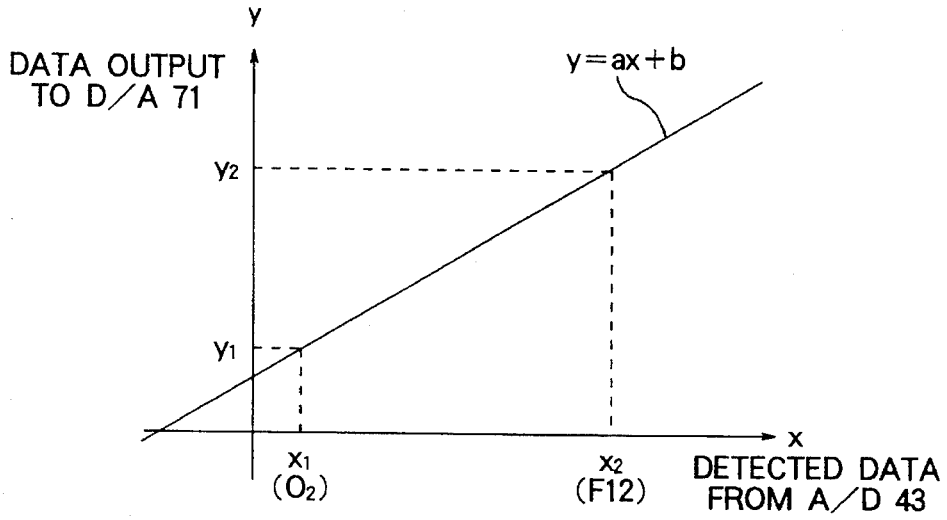
FIG. 3 is a graph showing the relation between output data from an A/D converting circuit 43 and detected data input to a D/A converting circuit 71 in the embodiment.

When the data y to be output to the D/A converting circuit 71 and required for displaying, on the smoke density display device **2*d*, a proper smoke density corresponding to the present output data x is computed by the control device 50 using the ROM 60, the relation between x and y is generally expressed by the equation, $y=ax+b$, as shown in FIG. 3**. It is explained below that the equation $y=ax+b$ is changed to the equation $$y=\{(Y_2-y_1)/(x_2-x_1)\}\cdot x+((y_1\cdot x_2-y_2\cdot x_1)/(x_2-x_1).$$

The following two equations are obtained from FIG. 3:

$$Y_1=ax_1+b$$

$$Y_2=ax_2+b$$

When simultaneous equations are solved on the basis of these equations, the following equations are obtained:

$$a=\{(Y_2-y_1)/(x_2-x_1)\}$$

$$b=(Y_1\cdot x_2-y_2\cdot x_1)(x_2-x_1)$$

With the substitution of a and b in the equation $y=ax+b$, therefore, the following equation is obtained:

$$y=ax+b=\{(y_2-y_1)/(x_2-x_1)\}\cdot x+(y_1\cdot x_2-y_1\cdot x_1)/(x_2-x_1)$$

The thus-determined output data y is supplied to the D/A converting circuit 7 in Step S4. The D/A converting circuit 71 converts the output data y into an analog signal which is sent to the fire receiver 2 by the signal output circuit 72. A proper smoke density corresponding to the present output data x from the A/D converting circuit 43 is displayed on the smoke density display device **2*d*. For example, if the present smoke density is 0.06%/m, portions "OK" and "0.01" to "0.06" are lighted, as shown in FIG. 4**C.

Figure 5:
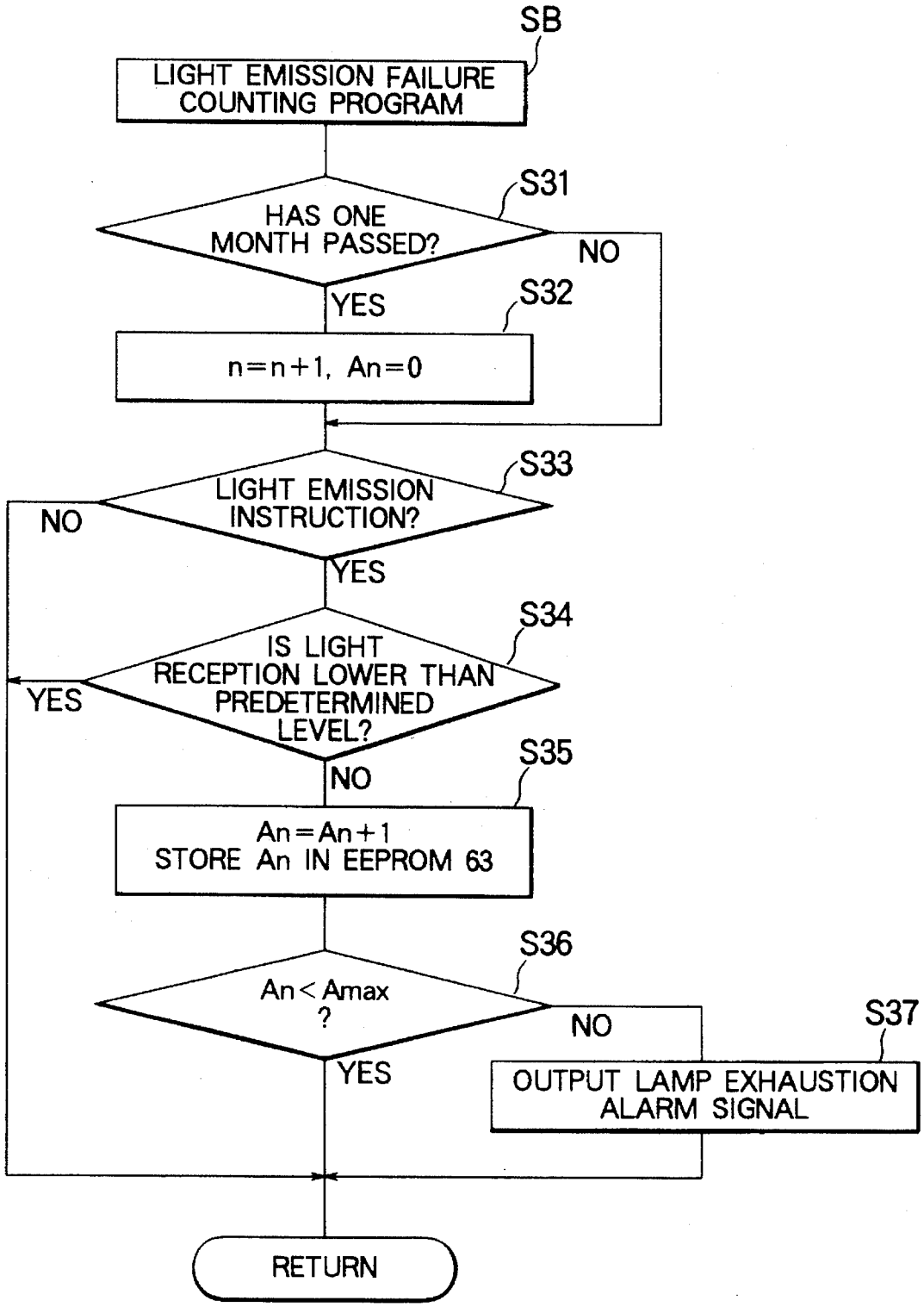
FIG. 5 is a flow chart showing the light emission failure counting program in the embodiment.

FIG. 5 is a flowchart showing the light emission failure counting program SB in this embodiment.

This embodiment stores the number of failures of the xenon lamp 10 to emit light when it is supposed to emit light, that is, the number of light emission failures, in each month. The counting means starts counting light emission failures for the first month after the smoke detector 1 has been installed or after the xenon lamp 10 has been replaced. Therefore, when the smoke detector 1 has been installed or when the xenon lamp has been replaced, the variable n representing the month is set to "1" and the function An representing the number of light emission failures in the month n is reset to "0" in the above described Step SO. After that, every time a month has passed from the last setting (Step S31), the variable n is increased by 1 and the function An representing the number of emission failures for the new month is reset to "0" (Step S32).

If the control circuit 50 outputs a light emission instruction (Step S33) and the level of the light received by the light receiving element 20 is lower than a predetermined level (Step S34), the number of light emission failures is increased by 1 (Step S35). More specifically, the function An representing the number of light emission failures in the current month is increased by 1, and the value of the function An is stored in the corresponding location of the EEPROM 63.

The control circuit 50 compares the value of the function An representing the number of light emission failures in the month with a predetermined alarm level Amax, e.g. seven in this embodiment (Step S36). If the total number An of light emission failures in the month is seven or more, a lamp exhaustion alarm signal is outputted from the lamp exhaustion alarm signal transmitting circuit 73 (Step S37). The lamp exhaustion alarm signal is transmitted to the fire receiver 2 via the connector C. The operation from Step S31 through Step S37 is executed every time a light emission instruction is outputted. Then, the sequence is returned.

FIG. 6 shows an example of data of the number of light emission failures stored in the EEPROM 63 according to Embodiment 1. In this example, no light emission failure occurs in the first six months, but the light emission failures occur once in each of the seventh and eighth months and, beyond that, occur three times, twice, three times, five times and ten times in the ninth through thirteenth months, respectively. With reference to the data stored in the EEPROM 63, it can be determined whether the xenon lamp 10 currently used in the smoke detector 1 should be replaced. More specifically, because the number of light emission failures, in general, gradually increases and reaches to a certain level before a xenon lamp is exhausted, the record of light emission failures of the xenon lamp indicates when it will be exhausted, and thereby it can be determined whether the xenon lamp 10 should be replaced at present.

The smoke detector 1 according to this embodiment outputs a lamp exhaustion alarm signal causing the fire receiver 2 to produce an alarm, if the number of light emission failures in the month is a predetermined number or more. Therefore, a maintenance person can tell by the alarm that the xenon lamp 10 will soon be exhausted, without looking at the data stored in the EEPROM 63. The lamp exhaustion alarm may be produced by various means, for example audible means, such as a bell or recorded message, or visual means such as an indicator lamp or a display.

Figure 7:
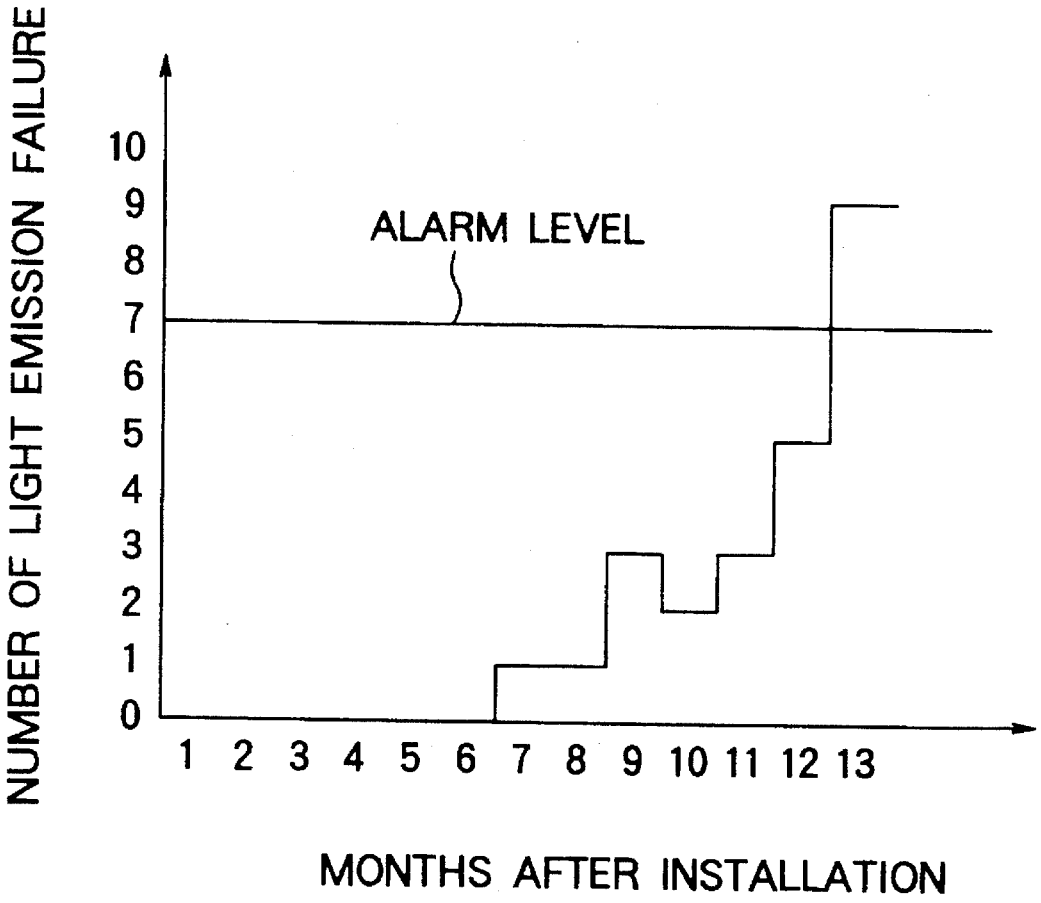
FIG. 7 indicates the relation between the alarm level and the numbers of light emission failures stored in the EEPROM 63 in the embodiment.

FIG. 7 is a graph indicating the relation between the numbers of light emission failures in each month stored in the EEPROM 63 and the alarm level. Although the alarm level Amax is set to seven in this embodiment, it may be set to another value.

Figure 8:
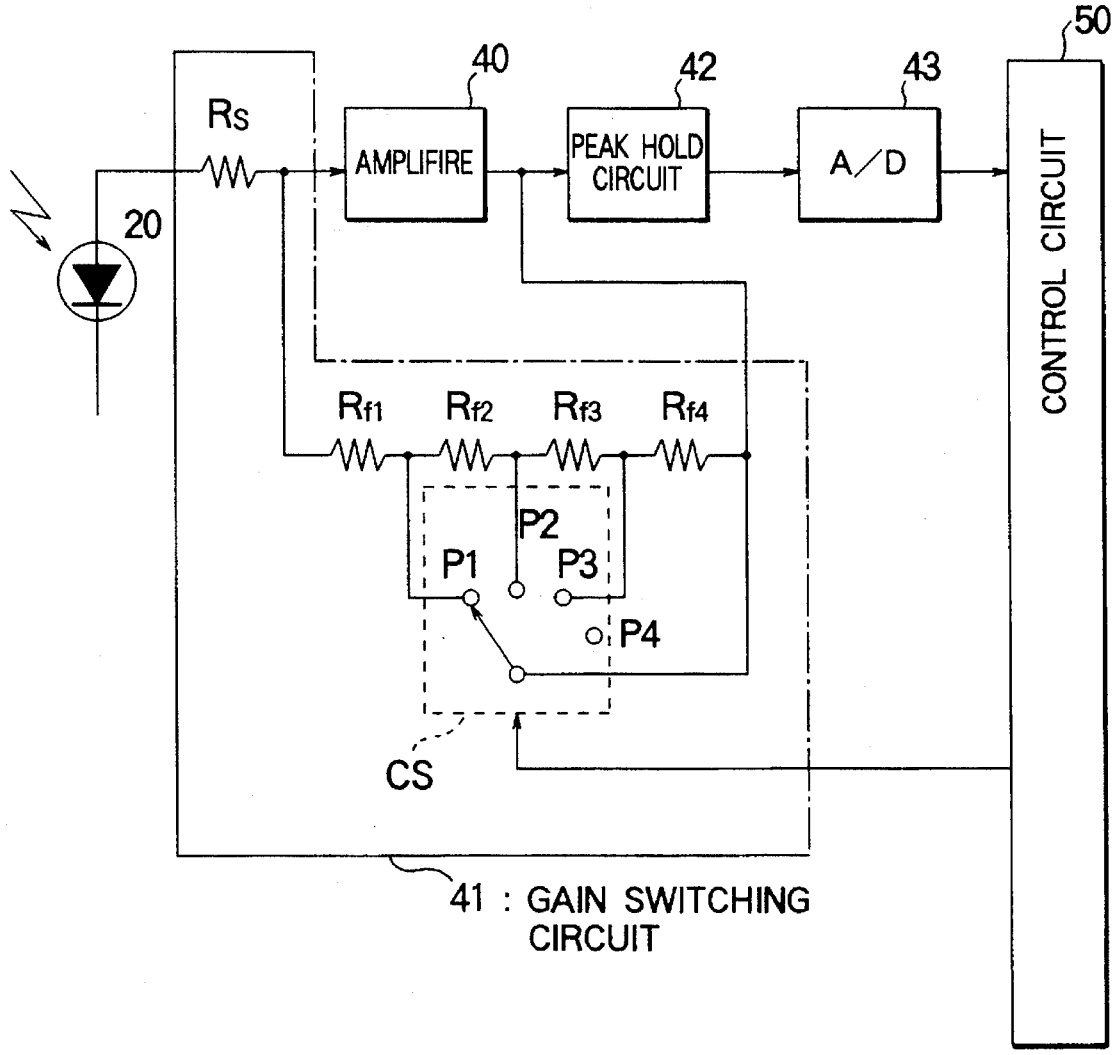
FIG. 8 is a circuit diagram showing a specific example of a gain switching circuit used in the embodiment.

FIG. 8 is a circuit diagram showing a specific example of the gain switching circuit 41 used in the above-described embodiment.

The gain switching circuit 41 includes a resistor Rs provided between the light receiving element 20 and the amplifier 40, resistors Rf1, Rf2, Rf3 and Rf4 connected in series to each other, and a rotary switch CS. The series circuit formed by the resistors Rf1, Rf2, Rf3 and Rf4 is connected between the input and output terminals of the amplifier 40. The rotary switch CS selectively connects the node P1 between the resistors Rf1 and Rf2, the node P2 between the resistors Rf2 and Rf3, the node P3 between the resistors Rf3 and Rf4, and a null point P4, to the output terminal of the amplifier 40, and actually consists of an electronic switch. The gain G of the amplifier 40 is substantially the same as the ratio of the combined value of the resistors Rf1, Rf2, Rf3 and Rf4 connected in series (which value varies depending on the switching of the rotary switch CS) to the value of the resistor Rs. That is, when the value of the resistors Rf2, Rf3 and Rf4 is set to 20% of the value of the resistor Rf1, and the rotary switch CS is sequentially switched to P1, P2, P3 and then P4, the gain G of the amplifier 40 varies 1 time, 1.2 times, 1.4 times and 1.6 times as its value in the condition in which the rotary switch CS is connected to the node P1.

Figure 9:
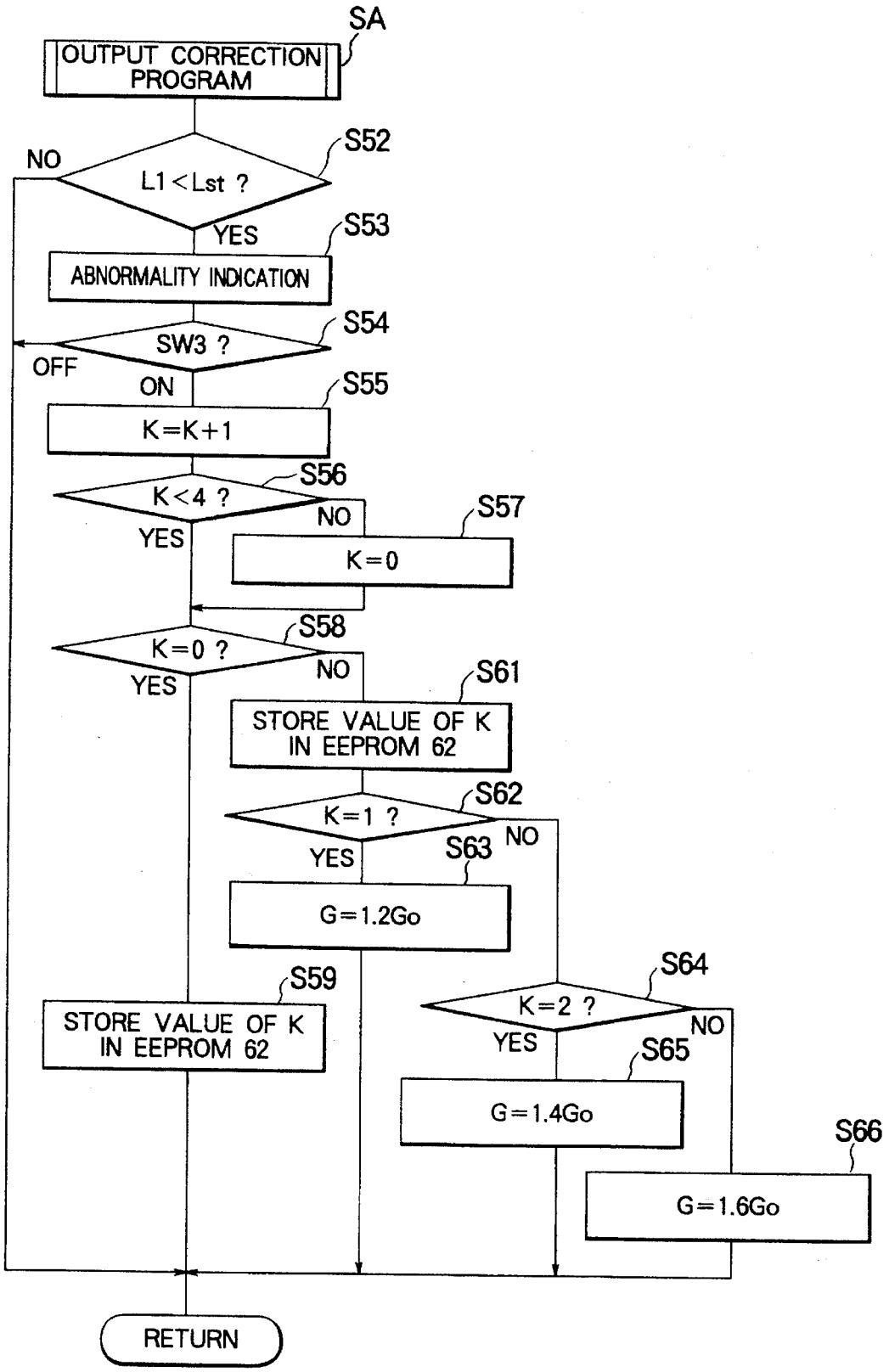
FIG. 9 is a flow chart showing the output correction program in the embodiment.

FIG. 9 is a flowchart showing the output correction program SA in the above-described embodiment.

First, the function K indicating the number of correction commands is set to "0" in the Step SO showing in FIG. 2. In this embodiment, the function K indicates the number of times the gain G of the amplifier 40 is corrected so as to be augmented. The correction is made when the level of the output signal of the light receiving element 20 has been gradually lowered as a result of a deterioration in the light emission efficiency of the xenon lamp 10 or in the light reception efficiency of the light receiving element 20 or as a result of contamination of the xenon lamp 10 and the light receiving element 20.

Then, the control circuit 50 compares the current output level L1 of the A/D conversion circuit 43 with a predetermined value Lst (Step S52). When the current output level L1 of the A/D conversion circuit 43 is equal to or higher than the predetermined value Lst, there is no problem regarding the current output level of the A/D conversion circuit 43, so that the procedure returns.

When the current output level L1 of the A/D conversion circuit 43 is lower than the predetermined value Lst, the smoke density cannot be detected in the normal fashion. That is, a detection error occurs in which the detector concludes that there is no fire even when smoke having a density corresponding to the density level of a fire has entered the smoke chamber 30. Therefore, in this case, an abnormality indication is given by an abnormality display device 75 (Step S53). When a person watching this abnormality indication has been holding the switch SW3 on for a period which is not less than one second and not more than five seconds (Step S54), that is, when a command to augment the gain G of the amplifier 40 has been given, the number of correction commands K is incremented by "1" (Step S55). If, at this time, the number of correction commands K is "4" or more (Step S56), the number of correction commands K is reset to "0" (Step S57). Thus, when the number of correction commands K is "0" (Step S58), "0" is stored in the EEPROM 62 as the number of correction commands K (Step S59). The length of the period for which the switch SW3 is held on is judged in Step S11 shown in FIG. 2. If it is the on state for correction (which is less than five seconds), the fact is stored in the RAM 64 as a flag, which is cleared when the number of correction commands K is incremented.

When the number of correction commands K is thus "0", the contact of the rotary switch CS shown in FIG. 8 is connected to the point P1, and the resistance of the feedback loop of the amplifier 40 and the peak hold circuit 42 consists of that of the resistor Rf1 only, the amplifier 40 operating with a gain G corresponding to the ratio of the value of the resistor Rs to the value of the resistor Rf1 (normal gain). That is, the gain G of the amplifier 40 is one time the normal value. Thus, assuming that the amplification factor $G_0$ of the amplifier 40 is 1000, the value of the gain G is set to 1000.

Suppose the number of correction commands K has been "0". If, in this condition, an abnormality display is given as a result of a deterioration in the light emission efficiency of the xenon lamp 10, etc. (Step S53) and the switch SW3 is held on for a period of less than five seconds (Step S54), the number of correction commands K is changed to "1" (Step S55) and it becomes necessary for the first time to correct the gain G of the amplifier 40. In this case, "1" is stored in the EEPROM 62 as the number of correction commands (Step S61), and the gain G of the amplifier 40 is corrected to 1.2 times the normal value (Steps S62 and S63), the abnormality display being cleared. At this time, the contact of the rotary switch CS shown in FIG. 8 is switched to the point P2 to cause the resistance of the feedback loop of the amplifier 40 and the peak hold circuit 42 to become that of the resistors Rf1+Rf2, the amplifier 40 operating with a gain corresponding to the ratio of the combined value of the resistors Rf1 and Rf2 to the value of the resistor Rs. That is, the gain G of the amplifier 40 becomes 1.2 times the normal value. Thus, assuming that the initial amplification factor $G_0$ was 1000, the gain G is 1.2 $G_0$, i.e., 1200.

By thus augmenting the gain G of the amplifier 40, it is possible for the smoke detector 1 to perform the normal operation without having to be replaced by an alternate detecting apparatus when the level of the output signal of the light receiving element 20 has been lowered as a result of a deterioration in the light emission efficiency of the xenon lamp 10, etc. Therefore, the smoke detecting operation can be continued. Further, this arrangement is advantageous with respect to maintenance efficiency.

When the output level of the light receiving element 20 is further lowered afterwards, an abnormality display is given again. By pushing the switch SW 3 (Steps S53 and S54), the number of correction commands K is changed to "2" (Step S55), and the gain G of the amplifier 40 is corrected again, "2" being stored in the EEPROM 62 as the number of correction commands K (Step S61). Since K=2, the gain G of the amplifier 40 is corrected to 1.4 times the normal value (Steps S62, S64 and S65). At the same time, the abnormality display is cleared. That is, the contact of the rotary switch CS shown in FIG. 8 is switched to the point P3 to cause the resistance of the feedback loop of the amplifier 40 and the peak hold circuit 42 to become that of the resistors Rf1+Rf2+Rf3, the amplifier 40 operating with a gain corresponding to the ratio the combined value of the resistors Rf1+Rf2+Rf3 to the value of the resistor Rs, and the gain G of the amplifier 40 being augmented to 1.4 times the normal value, i.e., 1.4 $G_0$.

When the output level of the light receiving element 20 is lowered again, an abnormality display is given. If, at this time, the switch SW3 is pushed (Steps S53 and S54), the number of correction commands K is changed to "3" (Step S55), and "3" is stored in the EEPROM 62 as the number of correction commands K (Step S61). Since K=3, the gain G of the amplifier 40 is corrected to 1.6 times the normal value (Steps S62, S64 and S66), and the abnormality display is cleared. That is, the contact of the rotary switch CS shown in FIG. 8 is switched to the point P4, and the resistance of the feedback loop of the amplifier 40 and the peak hold circuit 42 becomes that of the resistors Rf1+Rf2+Rf3+Rf4. The amplifier 40 operates with a gain corresponding to the ratio of the combined value of the resistors Rf1+Rf2+Rf3+Rf4 to the resistance of the resistor Rs, the gain G of the amplifier 40 being augmented to 7.6 times the normal value, i.e., 1.6 $G_0$. After the execution of the above correction operations (Steps S63, S65 and S66), the procedure returns.

As described above, each time an abnormality display is given, the operation of pushing the switch SW3 is repeated several times until the abnormality display disappears. If the switch SW3 is erroneously pushed too many times and the number of correction commands K is augmented in excess of need, it is possible to set the number of correction commands K to a desired value by continuing to operate the switch SW3 until the desired value is reached at the next round. In the output correction of the smoke detector by the above-described operations, it is necessary to restore the value of the number of correction commands K to zero by operating the switch SW3 when the xenon lamp, etc. of the smoke detector is to be replaced with a new one. In this case, the switch SW3 is pushed several times with the former xenon lamp remaining in the apparatus. The position at which an abnormality display is given for the first time in the course of this operation is the position where the value of the number of correction commands K is zero.

Instead of augmenting the gain G of the amplifier 40 to 1.4 $G_0$, it is possible, in Step S15, to further multiply the gain G, which has been multiplied by 1.2 in Step S13, by 1.2 again (that is, to multiply the initially set gain $G_0$ of the amplifier by $1.2^2$). Further, instead of augmenting the gain G of the amplifier 40 to 1.6 $G_0$ in Step S16, it is also possible to further multiply the gain, which has already been multiplied by 1.2×1.2 times in Step S15, by 1.2 again (i.e., the initially set gain $G_0$ of the amplifier 40 is multiplied by $1.2^3$). Further, it is also possible to provide the smoke detector 1 or the receiver 2 with a display means for displaying the value K indicating the number of times that correction has been effected.

Figure 10A:
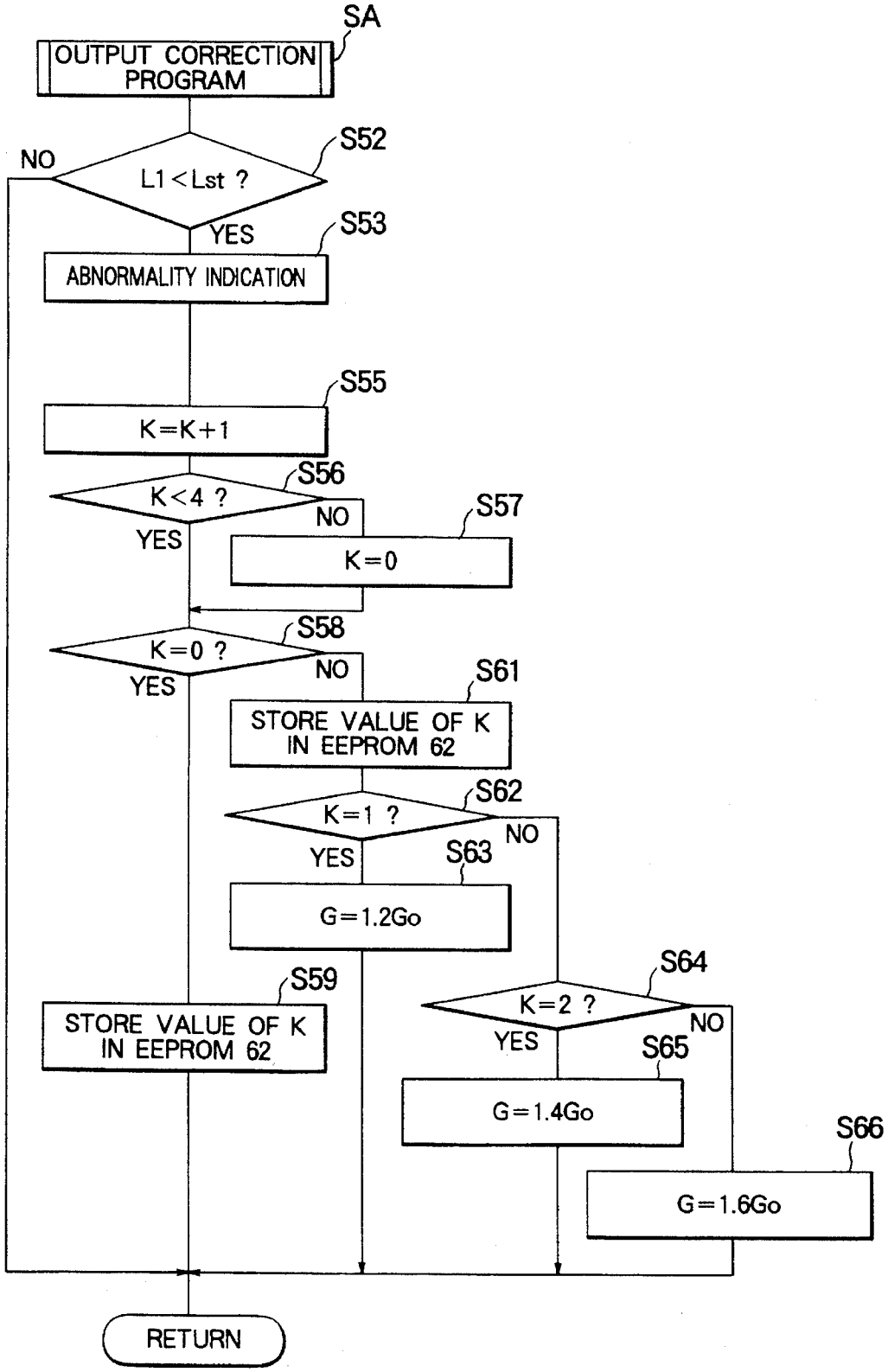
FIG. 10A is a flow chart showing the modified output correction program.

While in the above-described embodiment the gain of the amplifier 40 was corrected so as to be augmented, it is also possible to augment the gain automatically without pushing the switch SW3. In this case, the apparatus may be controlled such that the control circuit 50 augments the gain of the amplifier 40 when the level comparison means concludes that the value L1 of the output signal of the amplifier 40 to be equal to or lower than the reference value Lst. The flowchart of the output correction program executed in this case is shown in FIG. 10A.

In the above-described embodiment, the level comparison means, the abnormality display device 75, the gain augmentation command switch, and the gain augmentation means are provided in the smoke detector 1. Instead of this arrangement, it is possible to provide part or all of these components in the receiver 2 or in an unillustrated transmitter. For example, when the abnormality display device and the gain augmentation command switch are provided in the receiver 2, the smoke detector 1 transmits a signal to the receiver 2 to operate the abnormality display device when the level comparison means detects an abnormality. When the gain augmentation command switch is operated, the receiver 2 stores the fact in the corresponding EEPROM 62 and, at the same time, transmits a gain augmentation command signal to the smoke detector 1. In case of transmitting these signals through the signal line through which the signal indicative of smoke density is transmitted, a signal in a form different from that of the signal indicative of smoke density, for example, a pulse code, can be used.

While in the above-described embodiment a xenon lamp was used, the above description also applies to cases where light emitting lamps other than xenon lamps are used. Further, while in the above embodiment an analog signal was used as the signal indicative of smoke density, which is to be transmitted to the receiver 2, the signal may also be a digital one. In that case, the D/A conversion circuit 71 is not necessary. Also, instead of the abnormality display device 75, it is possible to employ an abnormality alarm device utilizing a buzzer or the like.

Figure 10B:
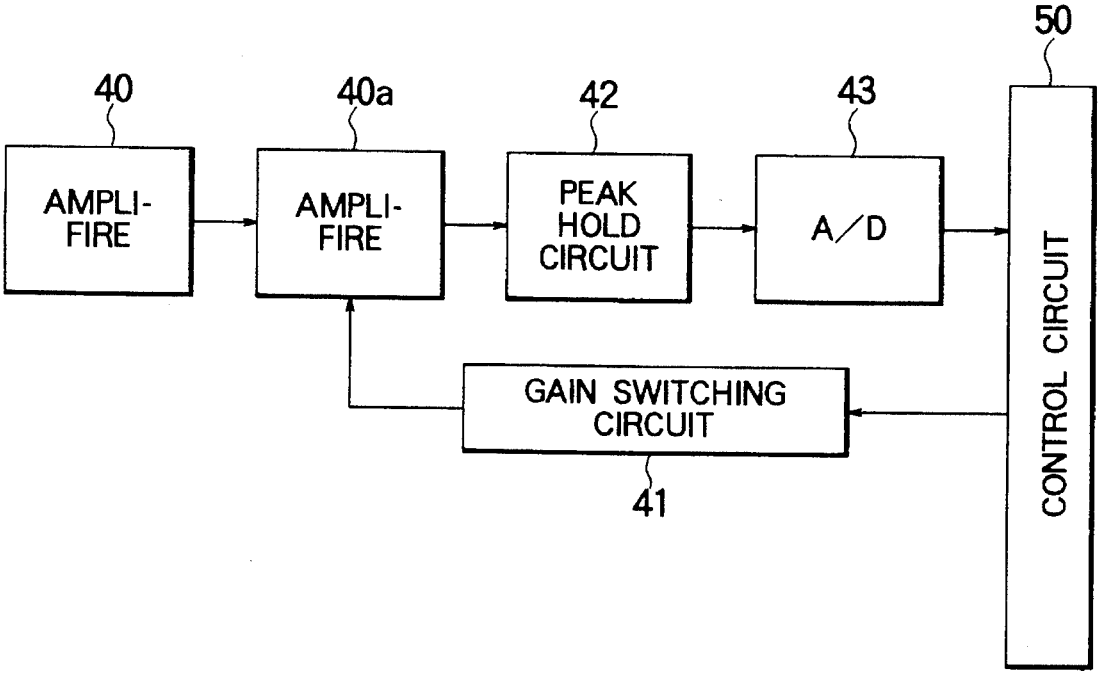
FIG. 10B is a block diagram showing a part of a modification of the embodiment shown in FIG. 1.

Further, while in the above-described embodiment only one amplifier 40 is provided, it is possible to provide another amplifier **40*a* between the amplifier 40 and the peak hold circuit 42, as shown in FIG. 10B, augmenting the gain of this additional amplifier 40*a* by using the gain switching circuit 41. In this case, there is no need to augment the gain of the amplifier 40. Further, it is also possible for this additional amplifier to be provided between the peak hold circuit 42** and the A/D conversion circuit 43. That is, it is possible to form the amplifier for augmenting the gain in accordance with a command from the gain augmentation command switch as an amplification circuit consisting of one stage or a plurality of stages.

Figure 11:
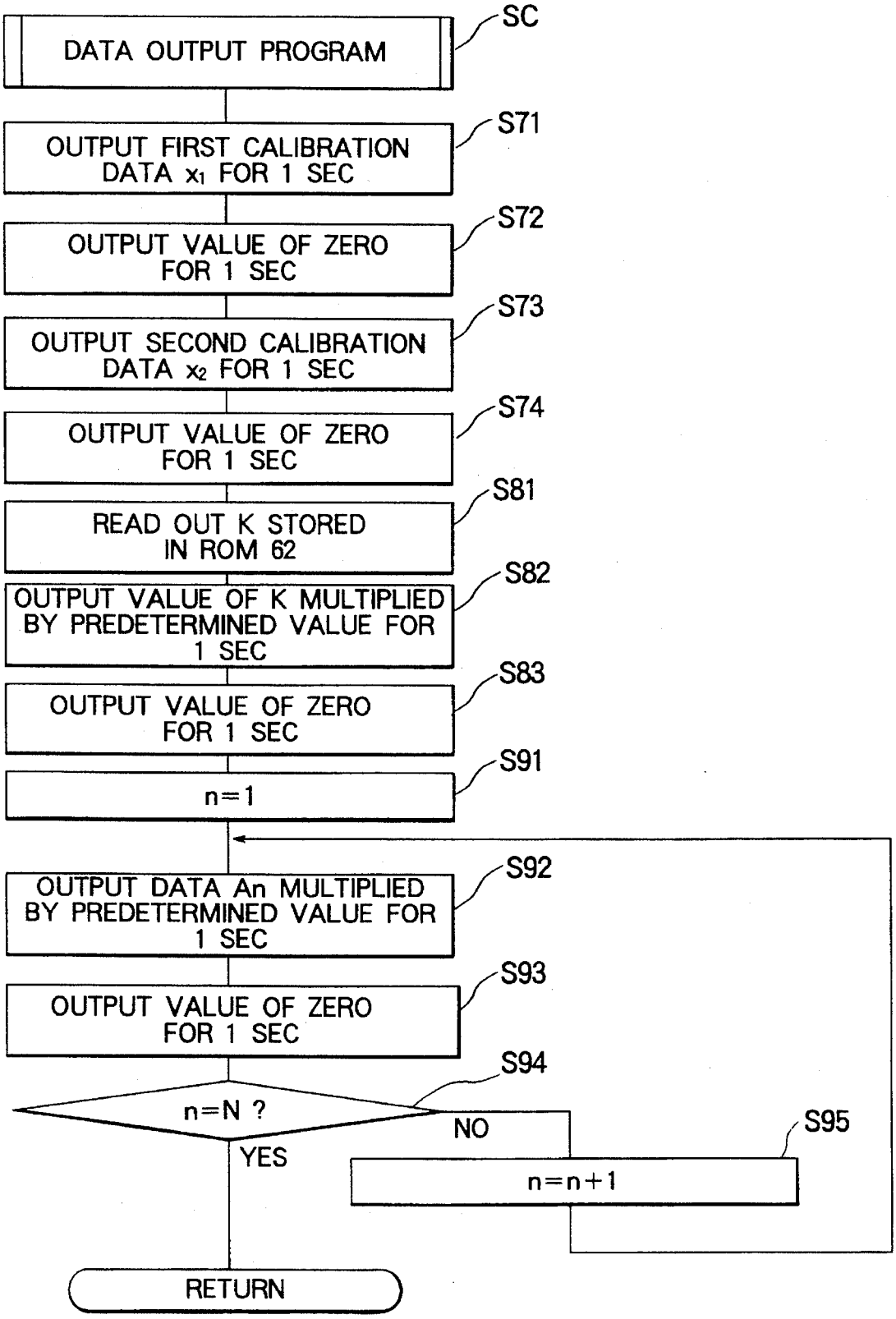
FIG. 11 is a flow chart showing the data output program in the embodiment.
Figure 12:
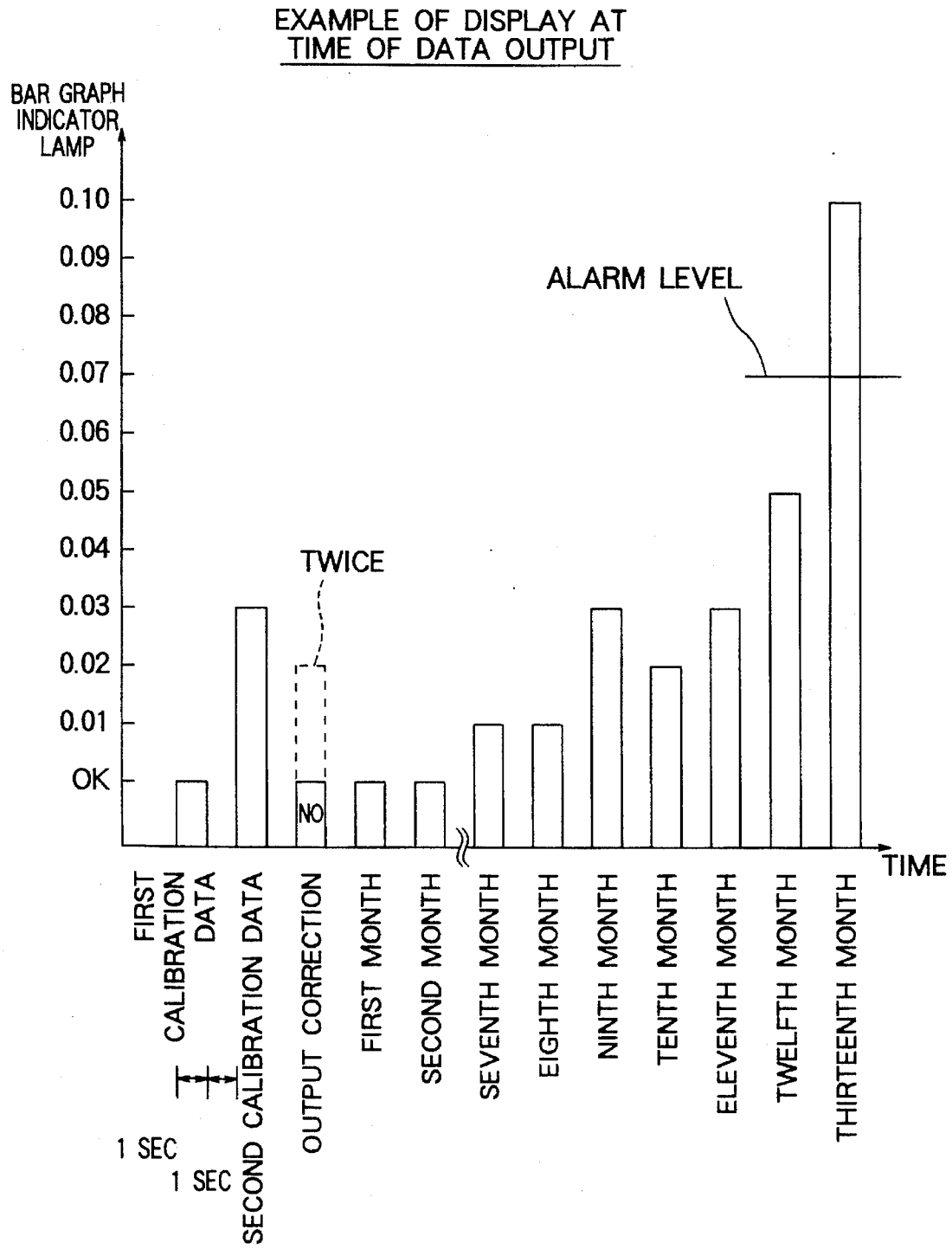
FIG. 12 is a diagram showing an example of a display on the smoke density display device 2*d;*

FIG. 11 is a flowchart showing a data output program SC in the above embodiment, and FIG. 12 is a diagram showing an example of a display on the smoke density display device 2*d* (consisting of a bar graph indicator lamp) at the time of data output.

In this case, as shown in FIG. 1, connected to the smoke detector 1 through a connector C is the receiver 2, which is provided with a smoke density display device 2*d* having bar graph indicating lamps as shown in FIGS. 4A–4C. Thus, the contents of the various items of data stored in the ROMs 61, 62 and 63 are displayed on the smoke density display device 2*d* having bar graph indicating lamps.

First calibration data $x_1$ is first read out from the ROM 61, and output for one second to the smoke density display device 2*d* having bar graph indicating lamps (Step S71). Here, the first calibration data $x_1$ represents the smoke density when pure oxygen gas is supplied to the smoke chamber 30, which density is 0.005%/m. When displayed on the smoke density display device 2*d* having bar graph indicating lamps, the density is less than 0.01%/m, so that only the display "OK" is lighted for one second as shown in FIG. 4A. Then, the value of zero is output for one second (Step S72) to put off all the display on the bar graph indicating lamps of the smoke density display device 2*d*. The reason for thus putting off all the display for one second is to visually clarify the pause between one display and another.

Next, second calibration data $x_2$ is read out from the ROM 61, and output for one second to the smoke density display device 2*d* (Step S73). Here, the second calibration data $x_2$ represents the smoke density when pure flon 12 gas is supplied to the smoke chamber 30, which density is 0.035%/m. When this density is displayed on the smoke density display device 2*d*, only the displays of "OK" and "0.01"~"0.03" are lighted for one second, as shown in FIG. 4B. Then, the value of zero is output for one second (Step S74), and all the display on the bar graph indicating lamps of the smoke density display device 2*d* is put off.

Then, the value K indicating the number of times that gain correction has been effected, stored in the ROM 62, is read out (Step S81), and is output after being multiplied by a predetermined value, e.g., 0.01 (Step S82). Thus, when the gain has been corrected, for example, two times, K is 2 which is then multiplied by 0.01 to give 0.02. As indicated by the broken lines in FIG. 12, the displays of "OK", "0.01", and "0.02" are lighted on the bar graph indicating lamps of the smoke density display device 2*d*, indicating that the number of times that the correction has been effected is 2. When no gain correction has been performed, K=0. In this case, no display may be lighted on the smoke density display device 2*d* having bar graph indicating lamps, or, as indicated by the solid lines in FIG. 12, the display of "OK" may be lighted, the value of zero being output for one second (Step S83).

The number of light emission failures in each month is displayed. Prior to this display, the variable n indicating the number of months that have elapsed is set to "1" (Step S91), and a value obtained by multiplying the data An indicative of the number of light emission failures in the n-th month by a predetermined value, for example, 0.01, is output for one second from the ROM 63 to the smoke density display device 2*d* having bar graph indicating lamps (Step S92), the above operation being repeated until the last month (Steps S94 and S95). Here, the number of light emission failures for the first to sixth months is "0", so that only the display of "OK" is lighted on the bar graph indicating lamps of the smoke density display device 2*d*. Since the number of light mission failures in the seventh and eighth months is "1", the displays of "OK" and "0.01" are lighted on the bar graph indicating lamps of the smoke density display device 2*d*. Since the number of light emission failures in the ninth month is "3", the displays of "OK" and "0.01"~"0.03" are lighted on the bar graph indicating lamps of the smoke density display device 2*d*. By this arrangement, it is possible to easily recognize the number of light emission failures from the display on the bar graph indicating lamps of the smoke density display device 2*d*. Further, by counting the number of times that the lamps have been lighted, it is possible to easily recognize the month in which light emission failure has occurred most often.

While in the above-described embodiment the contents of the various items of data stored in the ROMs 61, 62 and 63 are displayed on the bar graph indicating lamps of the smoke density display device 2*d*, it is also possible to connect a pen recorder, a personal computer or the like to the smoke detector 1 through the connector C, displaying the contents of the various items of data through the pen recorder, the personal computer, etc.

While in the above-described embodiment the smoke detector 1 transmits an analog signal to the receiver 2, the smoke detector 1 may transmit a digital signal to the receiver 2.

Further, while in the above-described embodiment data is output to the receiver 2 by operating the switches SW1, SW2 and SW3 provided in the smoke detector 1, it is also possible to provide the switches SW1, SW2 and SW3 in the receiver 2, causing the data output to the receiver 2 to be started through operation of the switches in the receiver 2, calling data to the smoke density display device 2*d* of the receiver 2.

Also, while in the above embodiment the EEPROM 61 for the detection value of reference gas for calibration, the EEPROM 62 for the output value correction, and the EEPROM 63 for the storage of the number of light emission failures are provided in the smoke detector 1, it is also possible to provide these EEPROMS 61, 62 and 63 in the receiver 2, or in an unillustrated transmitter.

Figure 13:
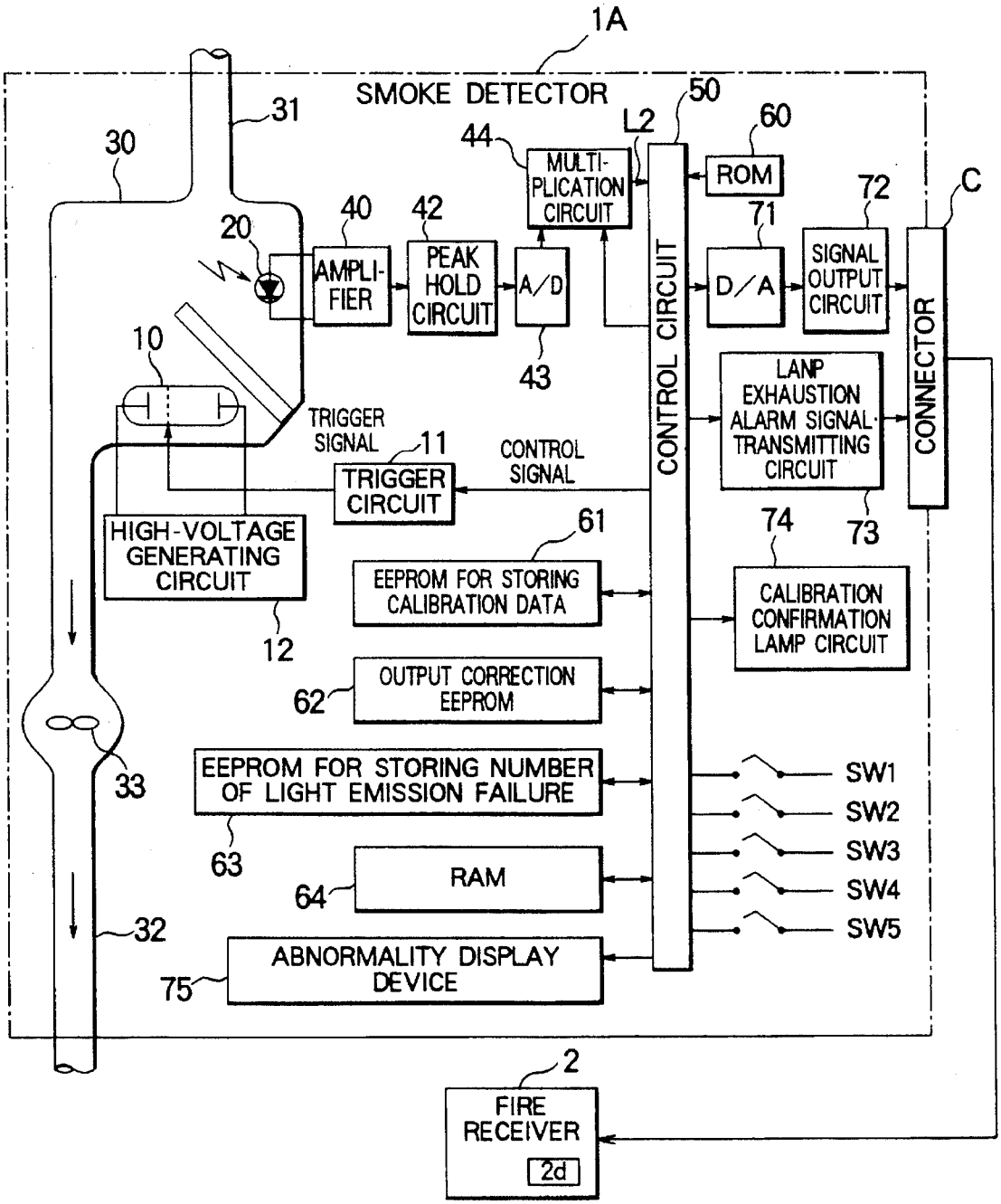
FIG. 13 is a block diagram of a smoke detecting apparatus according to another embodiment of the present invention.

Further, while in the above-described embodiment the gain G of the amplifier 40 is corrected by the gain switching circuit 41 in the output correction program SA, this should not be construed restrictively. As shown in FIG. 13, it is also possible to connect a multiplication circuit 44 between the A/D conversion circuit 43 and the control circuit 50, augmenting the multiplying factor M of the multiplication circuit 44 by the control circuit 50 in accordance with a command given by the switch SW3. In this case, there is no need to augment the gain G of the amplifier 40, so that the gain switching circuit 41 is not needed.

Figure 14:
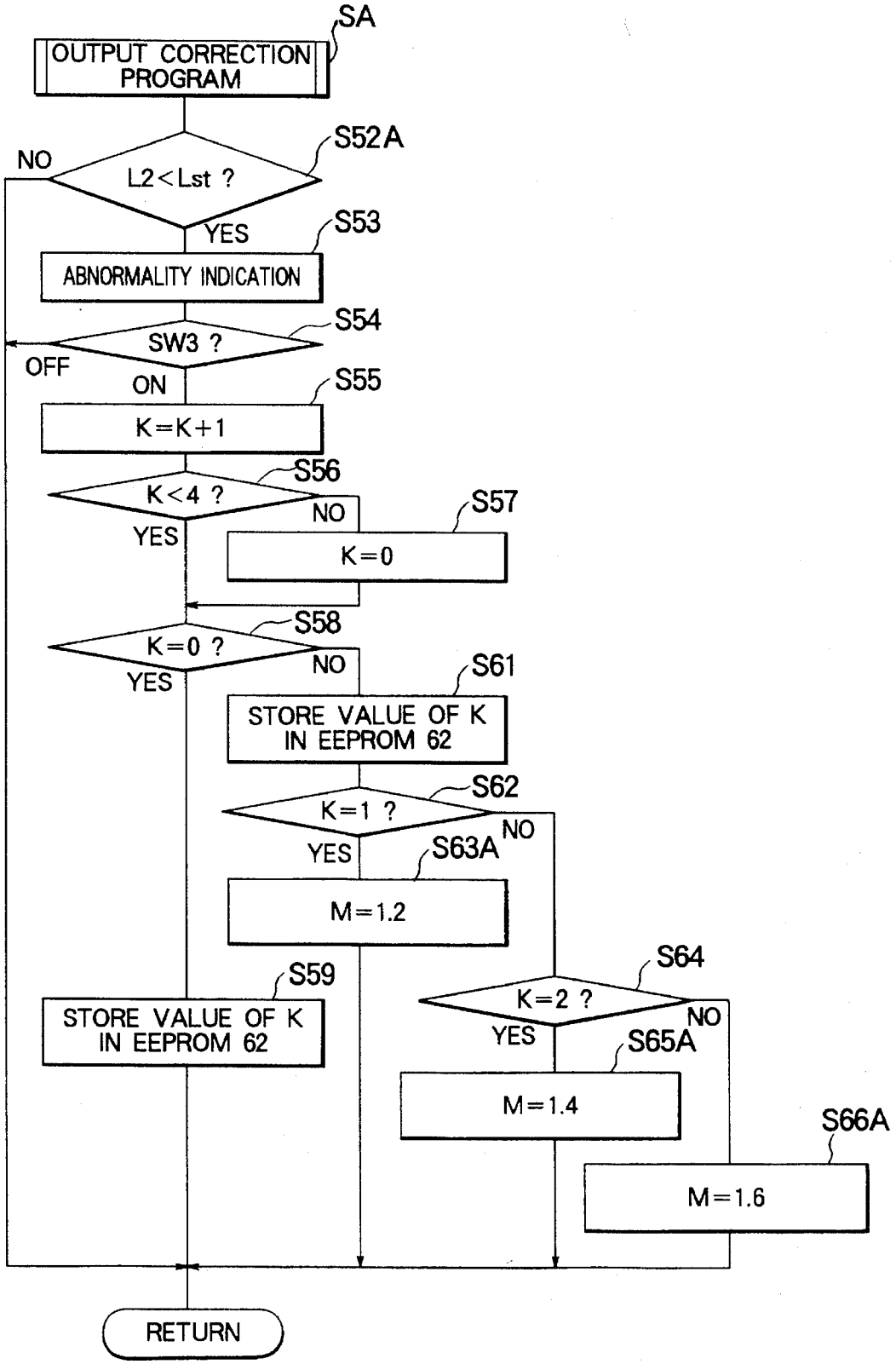
FIG. 14 is a flow chart showing the output correction program in the embodiment shown in FIG. 13.

FIG. 14 shows the flowchart of the output correction program SA used in this case. Instead of the Step S52 in the flowchart shown in FIG. 9, there is provided a Step S52A, in which the control circuit 50 compares the output value L2 of the multiplication circuit 44 with the predetermined value Lst, and, instead of the steps S63, S65 and S66, there are provided steps S63A, S65A and S66A, in which the multiplying factor M of the multiplication circuit 44 is set to 1.2, 1.4, and 1.6, respectively. By this arrangement, it is possible to obtain the same effect as in the above embodiment, in which the gain G of the amplifier 40 is augmented by the gain switching circuit 41.

Figure 15:
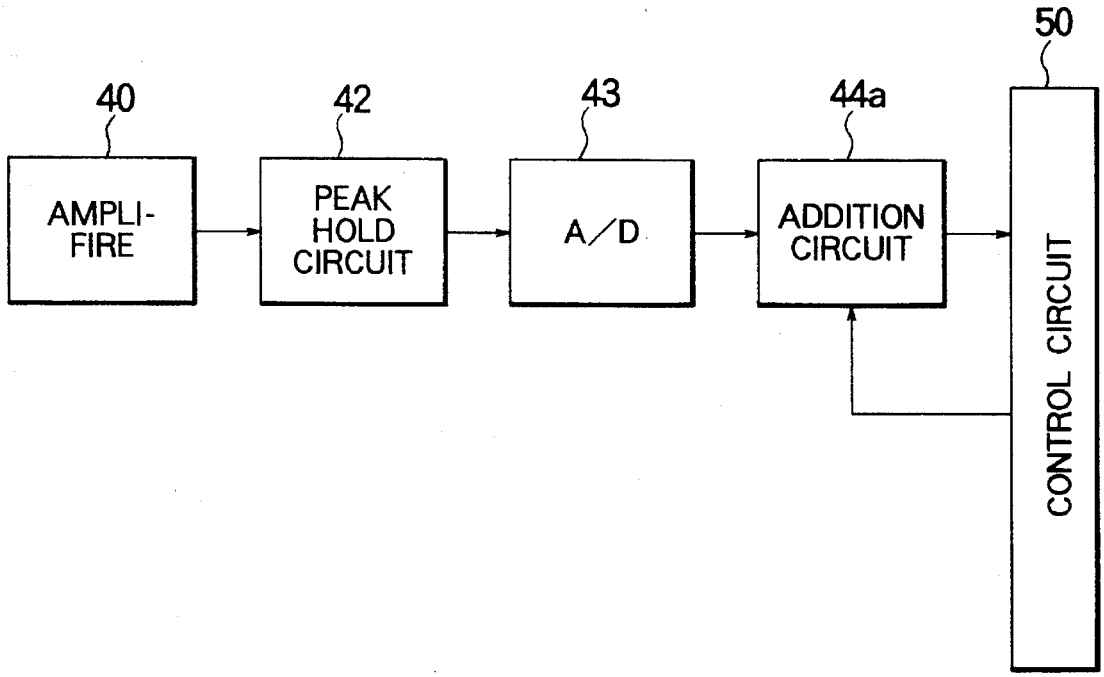
FIG. 15 is a block diagram showing a part of a modification of the embodiment shown in FIG. 14.

Instead of the multiplication circuit 44, which multiplies the digital signal output from the A/D conversion circuit 43 by M, it is also possible to provide an addition circuit 44*a* for adding an addition value to the output of the A/D conversion circuit 43, as shown in FIG. 15. In this case, the control circuit 50 sets one of several predetermined values to the addition circuit 44*a* as the addition value in accordance with the value of K. Further, instead of connecting the multiplication circuit 44 between the A/D conversion circuit 43 and the control circuit 50, it is possible for the control circuit 50 or the receiver 2 to have the function of a multiplication circuit or an addition circuit.

What is claimed is:

1. A smoke detecting apparatus comprising:

a smoke chamber into which smoke to be detected is introduced;

a light emitting lamp disposed in said smoke chamber;

a light receiving element disposed in said smoke chamber so as to receive light emitted from said light emitting lamp and scattered by said smoke;

amplification means for amplifying an output signal from said light receiving element;

augmentation means for augmenting, upon receipt of a command, the output signal of said amplification means; and control means for (a) detecting a density of the smoke on the basis of an output signal from said amplification means, (b) comparing an amplitude of the output signal from said amplification means with a fixed value, and (c) generating an abnormality indication when the amplitude of the output signal from said amplification means is judged to be smaller than said fixed value;

augmentation command switch means manually switched on to apply said command to said augmentation means, the amplitude of the output signal from said amplification means being gradually augmented every time said augmentation command switch means is manually switched on when the abnormality indication is generated by said control means.

2. An apparatus according to claim 1 wherein said amplification means includes a first amplifier for amplifying the output signal from said light receiving element.

3. An apparatus according to claim 2 wherein said augmentation means includes a first gain switching circuit for augmenting the gain of said first amplifier.

4. An apparatus according to claim 2 wherein said augmentation means includes a second amplifier for amplifying an output signal from said first amplifier.

5. An apparatus according to claim 1 wherein said amplification means includes: a first amplifier for amplifying the output signal from said light receiving element; an A/D conversion circuit for A/D-converting an output signal from said first amplifier; and a multiplication circuit for augmenting an output of said A/D conversion circuit.

6. An apparatus according to claim 5 wherein said augmentation means includes a multiplying factor augmenting circuit for augmenting a multiplying factor set in said multiplication circuit.

7. An apparatus according to claim 1 wherein said amplification means includes: a first amplifier for amplifying the output signal from said light receiving element; an A/D conversion circuit for A/D-converting an output signal from said first amplifier; and an addition circuit for adding an additions, value to an output of said A/D conversion circuit.

8. An apparatus according to claim 7 wherein said augmentation means includes an addition value augmenting circuit for augmenting an addition value set in said addition circuit.

9. A smoke detecting apparatus comprising:

a smoke chamber into which smoke to be detected is introduced;

a light emitting lamp disposed in said smoke chamber;

a light receiving element disposed in said smoke chamber so as to receive light emitted from said light emitting lamp and scattered by said smoke;

amplification means for amplifying an output signal from said light receiving element;

detection means for detecting a density of the smoke on the basis of an output signal from said amplification means;

comparison means for comparing an amplitude of the output signal from said amplification means with a fixed value;

augmentation command switch means manually switched on to generate a command when the amplitude of the output signal from said amplification means is judged to be smaller than said fixed value by said comparison means; and an augmentation means for augmenting the output signal of said amplification means in accordance with the generation of said command by said augmentation command switch means, the amplitude of the output signal from said amplification means being gradually augmented every time said augmentation command switch means is manually switched on when the amplitude of the output signal from said amplification means is judged to be smaller than said fixed value by said comparison means.

10. An apparatus according to claim 9 further comprising an abnormality output means for outputting an abnormality indication when the value of the output signal from said amplification means is judged to be smaller than said fixed value by said comparison means.

11. An apparatus according to claim 9 wherein said amplification means includes a first amplifier for amplifying the output signal from said light receiving element.

12. An apparatus according to claim 11 wherein said augmentation means includes a first gain switching circuit for augmenting the gain of said first amplifier.

13. An apparatus according to claim 11 wherein said augmentation means includes a second amplifier for amplifying an output signal from said first amplifier.

14. An apparatus according to claim 9 wherein said amplification means includes: a first amplifier for amplifying the output signal from said light receiving element; an A/D conversion circuit for A/D-converting an output signal from said first amplifier; and a multiplication circuit for augmenting an output of said A/D conversion circuit.

15. An apparatus according to claim 14 wherein said augmentation means includes a multiplying factor augmenting circuit for augmenting a multiplying factor set in said multiplication circuit.

16. An apparatus according to claim 9 wherein said amplification means includes: a first amplifier for amplifying the output signal from said light receiving element; an A/D conversion circuit for A/D-converting an output signal from said first amplifier; and an addition circuit for adding an addition value to an output of said A/D conversion circuit.

17. An apparatus according to claim 16 wherein said augmentation means includes an addition value augmenting circuit for augmenting an addition value set in said addition circuit.

* * * * *